US009240123B2

(12) United States Patent
Stenneth

(10) Patent No.: US 9,240,123 B2
(45) Date of Patent: Jan. 19, 2016

(54) SYSTEMS AND METHODS FOR DETECTING ROAD CONGESTION AND INCIDENTS IN REAL TIME

(71) Applicant: HERE Global B.V., Veldhoven (NL)

(72) Inventor: Leon Stenneth, Chicago, IL (US)

(73) Assignee: HERE Global B.V., Veldhoven (NL)

( * ) Notice: Subject to any disclaimer, the term of this patent is extended or adjusted under 35 U.S.C. 154(b) by 77 days.

(21) Appl. No.: 14/105,501

(22) Filed: Dec. 13, 2013

(65) Prior Publication Data

US 2015/0170514 A1 Jun. 18, 2015

(51) Int. Cl.
*G08G 1/01* (2006.01)

(52) U.S. Cl.
CPC ..... *G08G 1/0125* (2013.01); *G08G 1/0129* (2013.01)

(58) Field of Classification Search
CPC .. G08G 1/0125; G08G 1/0129; G08G 1/0133
See application file for complete search history.

(56) References Cited

U.S. PATENT DOCUMENTS

| | | | | |
|---|---|---|---|---|
| 6,177,885 | B1 | 1/2001 | Weil et al. | |
| 7,145,475 | B2 | 12/2006 | Kavner | |
| 8,055,015 | B2 | 11/2011 | Bouzar | |
| 2007/0208493 | A1* | 9/2007 | Downs et al. | 701/117 |
| 2008/0298891 | A1* | 12/2008 | Boucherat et al. | 404/1 |

FOREIGN PATENT DOCUMENTS

| | | | |
|---|---|---|---|
| EP | 0771447 | B1 | 2/2004 |
| EP | 1269447 | B1 | 12/2004 |
| EP | 2023308 | A1 | 2/2009 |
| WO | WO9720433 | A1 | 6/1997 |
| WO | WO0007113 | A1 | 2/2000 |

* cited by examiner

*Primary Examiner* — Khoi Tran
*Assistant Examiner* — Adam Mott
(74) *Attorney, Agent, or Firm* — Lempia Summerfield Katz LLC

(57) ABSTRACT

Apparatuses and methods are provided for determining real time traffic conditions. A candidate road is divided into road segments by perpendicular bisectors. A spatial sliding window is positioned over at least a portion of a road segment, wherein the spatial sliding window corresponds to a front end of the road segment in a direction of travel of the road segment. Real time probe data is received from mobile devices in probe vehicles or on travelers of the at least portion of the road segment within the spatial sliding window. The real time probe data is analyzed, and a computer program assists in determining the real time traffic conditions of the at least portion of the road segment within the spatial sliding window. Based on the analysis, the real time traffic conditions are reported.

16 Claims, 14 Drawing Sheets

SYSTEMS AND METHODS FOR DETECTING ROAD CONGESTION AND INCIDENTS IN REAL TIME

FIELD

The following disclosure relates to methods and systems for real time traffic systems and global positioning system (GPS) probes, or more particularly, methods and systems for identifying locations of potential traffic incidents/congestion using sensor (e.g., GPS) probe data. Probe data may include speed, heading, location, timestamp, etc., as obtained from a single sensor such as GPS or a combination of sensors such as GPS, accelerometer, and gyrometer.

BACKGROUND

Traffic reporters may rely on traffic information made available by government agencies. Also, online traffic reporting resources may suffer from infrequent updates, data entry errors, or delayed data input. These factors cause the traffic reporter to fail to timely report a major traffic incident or congestion, or continue to report an incident or congestion well after the incident or congestion has been cleared. Therefore, providing real time, accurate traffic information, such as for use in a navigation system, is a continuing effort.

SUMMARY

Methods are provided for determining real time traffic conditions. In one embodiment, the method comprises dividing a candidate road into road segments by perpendicular bisectors. The method further comprises receiving probe data from mobile devices in probe vehicles or on travelers on the candidate road, wherein the probe data includes geographic location probe data. The method further comprises performing, using a processor, a first map-matching process, wherein the geographic location probe data is aligned to the candidate road or a specific lane on the candidate road, forming aligned probe data. The method further comprises performing, using the processor, a second map-matching process, wherein the aligned probe data is shifted to one of the perpendicular bisectors on the candidate road, forming double map-matched probe data.

In another embodiment, the method comprises dividing a candidate road into road segments by perpendicular bisectors. The method further comprises positioning a spatial sliding window over at least a portion of a road segment, wherein the spatial sliding window aligns with a front end of the road segment in a direction of travel of the road segment. The method further comprises receiving real time probe data from mobile devices in probe vehicles or on travelers of the at least a portion of the road segment within the spatial sliding window. The method further comprises analyzing, by a processor, the real time probe data. The method further comprises determining real time traffic conditions of the at least a portion of the road segment within the spatial sliding window. The method further comprises reporting the real time traffic conditions.

Apparatuses are also provided for determining real time traffic conditions. In one embodiment, the apparatus comprises at least one processor and at least one memory including computer program code for one or more programs, wherein the at least one memory and the computer program code configured to, with the at least one processor, cause the apparatus to at least perform: (1) divide a candidate road into road segments by perpendicular bisectors; (2) receive probe data from mobile devices in probe vehicles or on travelers on the candidate road, wherein the probe data includes the geographic location probe data; (3) perform a first map-matching algorithm, wherein the geographic location probe data is aligned to the candidate road or a specific lane on the candidate road, forming aligned probe data; and (4) perform a second map-matching algorithm, wherein the aligned probe data is shifted to one of the perpendicular bisectors on the candidate road, forming double map-matched probe data.

In another embodiment, the apparatus comprises at least one processor and at least one memory including computer program code for one or more programs, wherein the at least one memory and the computer program code configured to, with the at least one processor, cause the apparatus to at least perform: (1) divide a candidate road into road segments by perpendicular bisectors; (2) position a spatial sliding window over at least a portion of a road segment, wherein the spatial sliding window corresponds to a front end of the road segment in a direction of travel of the road segment; (3) receive real time probe data from mobile devices in probe vehicles or on travelers of the at least portion of the road segment within the spatial sliding window; (4) analyze the real time probe data; (5) determine real time traffic conditions of the at least a portion of the road segment within the spatial sliding window; and (6) report the real time traffic conditions.

BRIEF DESCRIPTION OF THE DRAWINGS

Exemplary embodiments are described herein with reference to the following drawings.

DETAILED DESCRIPTION

The following embodiments include the detection, in real time, of the location of road congestion or a traffic incident, and the systems and methods for developing a historical database to assist in the real time analysis. As used herein, a "road" may refer to any traveling lane or pathway that may be capable of being monitored for traffic congestion/incident detection, or may become capable of being monitored for traffic congestion/incident detection in the future (e.g., a highway, city street, bus route, train route, walking/biking pathway, waterway).

Mobile Device and Navigation System

Figure 1:
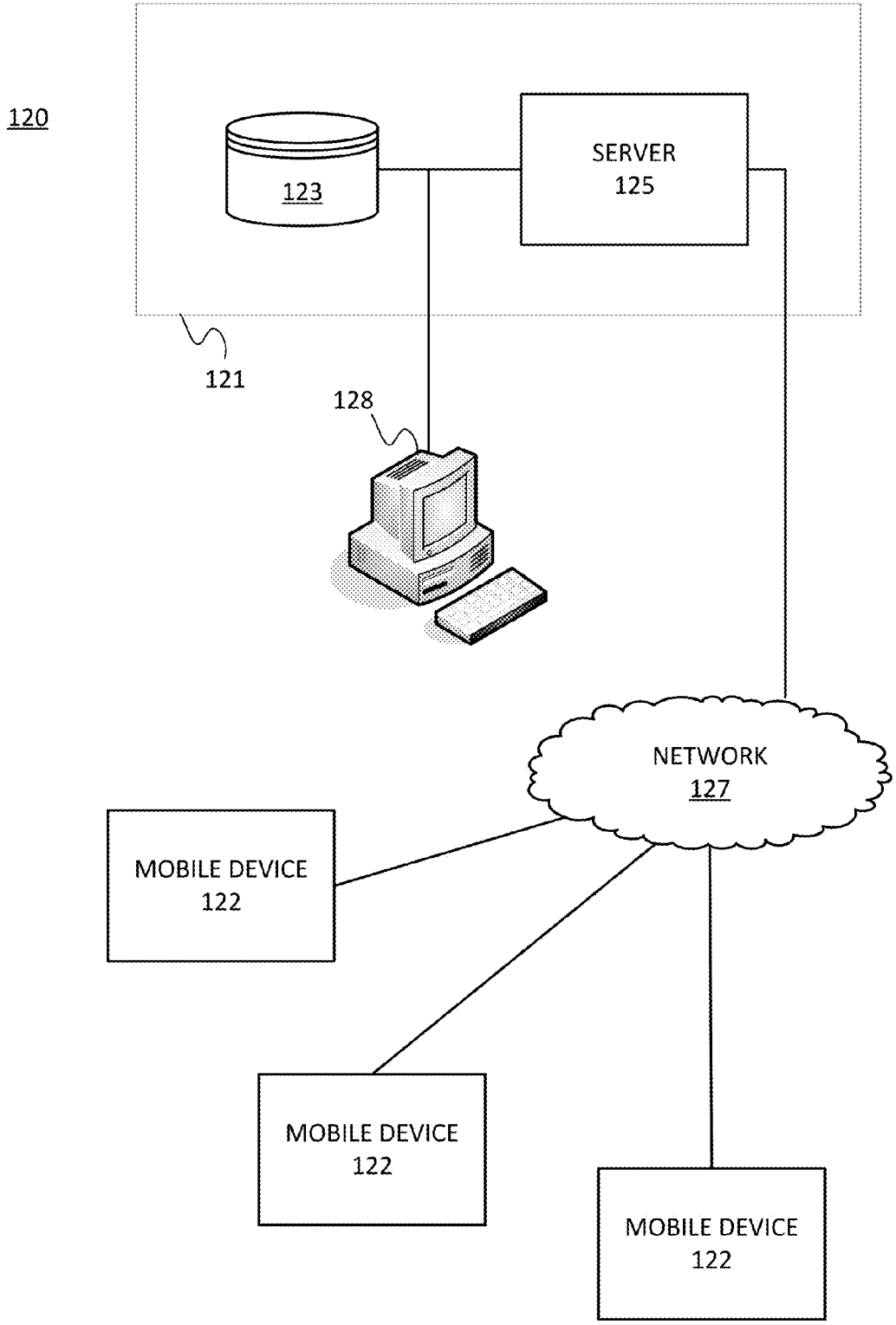
FIG. 1 illustrates an example system for traffic congestion or incident detection.

FIG. 1 illustrates an exemplary navigation system 120 for traffic congestion/incident detection. The navigation system 120 includes a map developer system 121, a mobile device 122, a workstation 128, and a network 127. Additional, different, or fewer components may be provided. For example, many mobile devices 122 and/or workstations 128 may connect with the network 127.

The mobile device 122 may be a smart phone, a mobile phone, a personal digital assistant ("PDA"), a tablet computer, a notebook computer, a personal navigation device ("PND"), a portable navigation device, and/or any other known or later developed mobile device. In certain embodiments, the mobile device 122 is transported in or on a probe vehicle (e.g., car, truck, motorcycle, bicycle, bus) or on a traveler. The mobile device 122 is configured to calculate probe data such as geographic location, speed, and heading of the mobile device 122. The probe data may be determined through Global Positioning System (GPS) or another technique. The probe data may include speed, heading, location, timestamp, etc., as obtained from a single sensor such as GPS or a combination of sensors such as GPS, accelerometer, and gyrometer. In certain embodiments, the mobile device 122 generates a message that provides at least one of (1) geographic location, (2) speed, (3) heading, and (4) vehicle identification (including timestamp), and sends the message to the server 125.

The developer system 121 includes a server 125 and a database 123. The developer system 121 may include computer systems and networks of a system operator such as HERE, NAVTEQ or Nokia Corporation. The geographic database 123 is configured to store messages from the mobile devices 122. The database 123 may be partially or completely stored in the mobile device 122.

The server 125 is configured to receive a plurality of messages (i.e., at least two) from a plurality of mobile devices 122 and identify a route or path that each mobile device 122 is likely following. Multiple probe data messages over time from each mobile device 122 may be used to resolve any ambiguity regarding the given location, speed, and direction of each mobile device 122.

The developer system 121, the workstation 128, and the mobile device 122 are coupled with the network 127. The phrase "coupled with" is defined to mean directly connected to or indirectly connected through one or more intermediate components. Such intermediate components may include hardware and/or software-based components.

The optional workstation 128 may be a general purpose computer including programming specialized for providing input to the server 125. For example, the workstation 128 may provide settings for the server 125. The settings may include a value for the predetermined interval that the server 125 requests mobile device 122 to relay current geographic locations. The workstation 128 may be used to enter data indicative of GPS accuracy to the database 123. The workstation 128 may include at least a memory, a processor, and a communication interface.

Figure 2:
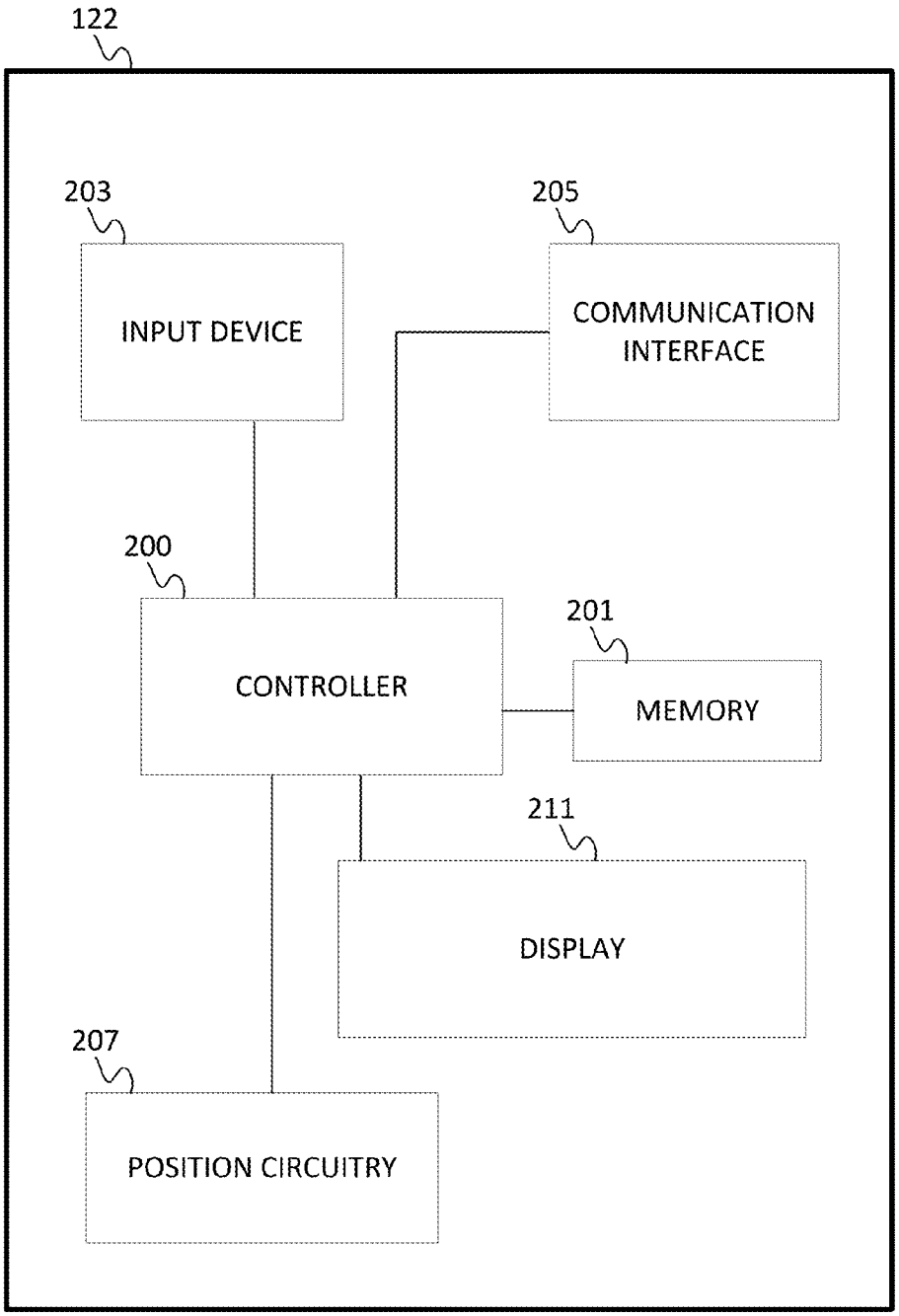
FIG. 2 illustrates an exemplary mobile device of the system of FIG. 1.

FIG. 2 illustrates an exemplary mobile device 122 of the navigation system of FIG. 1. The mobile device 122 may be referred to as a navigation device. The mobile device 122 includes a controller 200, a memory 204, an input device 203, a communication interface 205, position circuitry 207, and a display 211. Additional, different, or fewer components are possible for the mobile device 122.

The controller 200 is configured to receive data indicative of the location of the mobile device 122 from the position circuitry 207. The positioning circuitry 207, which is an example of a positioning system, is configured to determine a geographic position of the mobile device 122. The positioning circuitry 207 may include sensing devices that measure the traveling distance, speed, direction, and so on, of the mobile device 122. The positioning system may also include a receiver and correlation chip to obtain a GPS signal. The positioning circuitry may include an identifier of a model of the positioning circuitry 207. The controller 200 may access the identifier and query a database or a website to retrieve the accuracy of the positioning circuitry 207 based on the identifier. The positioning circuitry 207 may include a memory or setting indicative of the accuracy of the positioning circuitry.

Alternatively or additionally, the one or more detectors or sensors in the positioning circuitry 207 may include an accelerometer and/or a magnetic sensor built or embedded into or within the interior of the mobile device 122. The accelerometer is operable to detect, recognize, or measure the rate of change of translational and/or rotational movement of the mobile device 122. The magnetic sensor, or a compass, is configured to generate data indicative of a heading of the mobile device 122. Data from the accelerometer and the magnetic sensor may indicate orientation of the mobile device 122. The mobile device 122 receives location data from the positioning system. The location data indicates the location of the mobile device 122.

The positioning circuitry 207 may include a Global Positioning System (GPS), Global Navigation Satellite System (GLONASS), or a cellular or similar position sensor for providing location data. The positioning system may utilize GPS-type technology, a dead reckoning-type system, cellular location, or combinations of these or other systems. The positioning circuitry 207 may include suitable sensing devices that measure the traveling distance, speed, direction, and so on, of the mobile device 122. The positioning system may also include a receiver and correlation chip to obtain a GPS signal. The mobile device 122 receives location data from the positioning system. The location data indicates the location of the mobile device 122.

Figure 3:
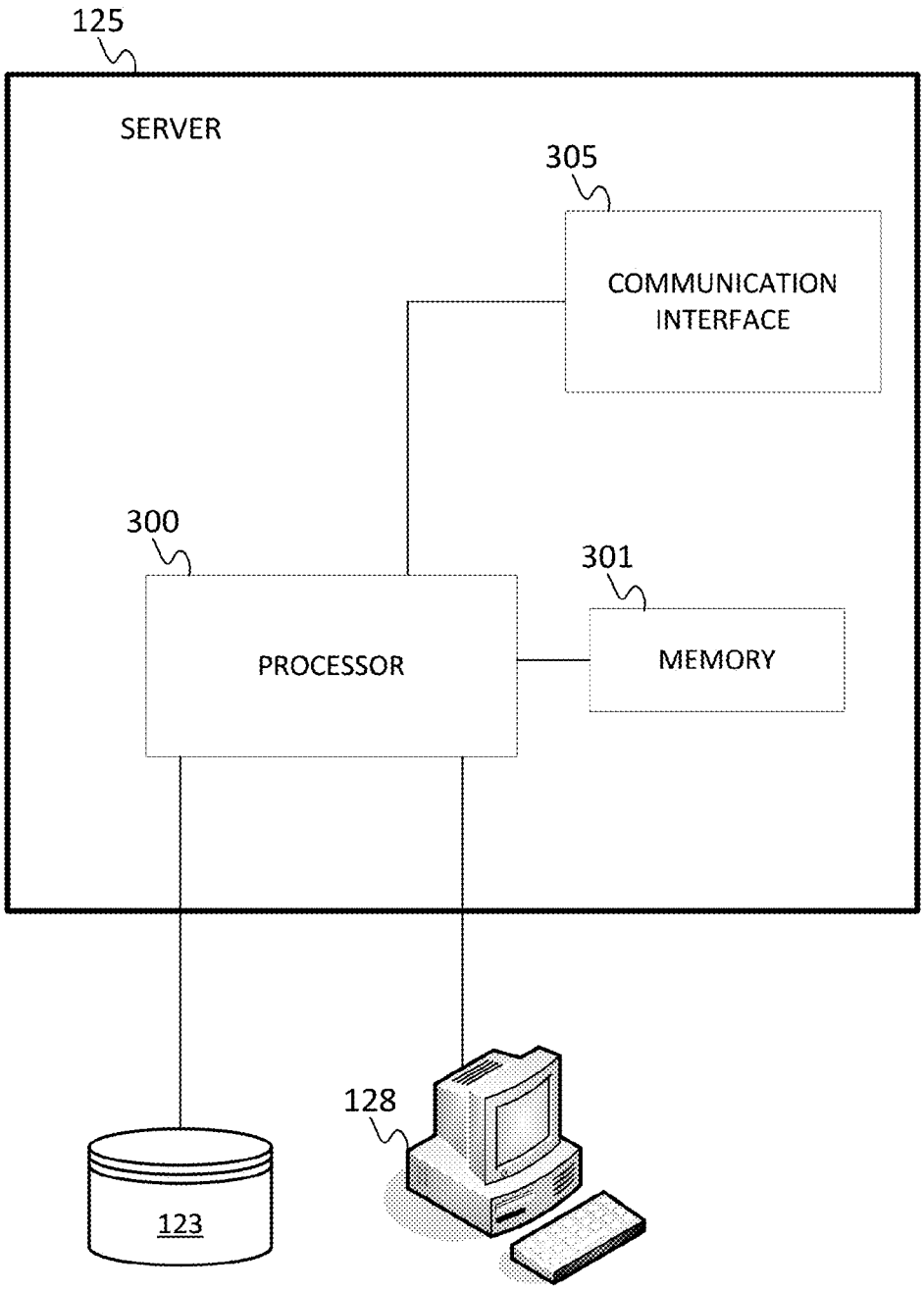
FIG. 3 illustrates an exemplary server of the system of FIG. 1.

FIG. 3 illustrates an exemplary server 125 of the navigation system of FIG. 1. The server 125 includes a processor 300, a communication interface 305, and a memory 301. The server 125 may be coupled to a database 123 and a workstation 128. The database 123 may be a geographic database as discussed above. The workstation 128 may be used as an input device for the server 125. In addition, the communication interface 305 is an input device for the server 125. The communication interface 305 receives data indicative of use inputs made via the workstation 128 or the mobile device 122.

The communication interface 305 is configured to receive periodic data indicative of a location of the mobile device 122 from the mobile device 122. The processor 300 is configured to analyze the periodic data to identify a path near the mobile device 122. The processor 300 may select the path nearest to the mobile device 122 from a set of paths stored in memory 301 or database 123.

The processor 300 is also configured calculate a target route based on characteristic information for the path. The characteristic information may include the actual width of the path. The path widths may be predetermined and stored in the database 123. Alternatively, the path widths may be based on detected locations over time. The characteristic information may include a classification of the path. The database 123 may include a lookup table that correlates path classifications and path widths.

The processor 300 is configured to determine whether the mobile device 122 deviates from the path based on a comparison of the location of the mobile device 122 to the target route. The comparison may involve calculating a distance between the center of the path width and the geographic location received from the mobile device 122. The comparison may involve comparing a threshold distance to the distance from the center of the path to the geographic location received from the mobile device 122. The threshold distance may be set according to the determined path width. The threshold distance and/or path width may be further adjusted according to an accuracy level of the periodic data indicative of the location of the mobile device. The accuracy level may be tied to the mobile device 122 or the positioning technique used by the mobile device 122.

The controller 200 and/or processor 300 may include a general processor, digital signal processor, an application specific integrated circuit (ASIC), field programmable gate array (FPGA), analog circuit, digital circuit, combinations thereof, or other now known or later developed processor. The controller 200 and/or processor 300 may be a single device or combinations of devices, such as associated with a network, distributed processing, or cloud computing.

The memory 204 and/or memory 301 may be a volatile memory or a non-volatile memory. The memory 204 and/or memory 301 may include one or more of a read only memory (ROM), random access memory (RAM), a flash memory, an electronic erasable program read only memory (EEPROM), or other type of memory. The memory 204 and/or memory 301 may be removable from the mobile device 122, such as a secure digital (SD) memory card.

The communication interface 205 and/or communication interface 305 may include any operable connection. An operable connection may be one in which signals, physical communications, and/or logical communications may be sent and/or received. An operable connection may include a physical interface, an electrical interface, and/or a data interface. The communication interface 205 and/or communication interface 305 provides for wireless and/or wired communications in any now known or later developed format.

Map-Matching

Figure 4:
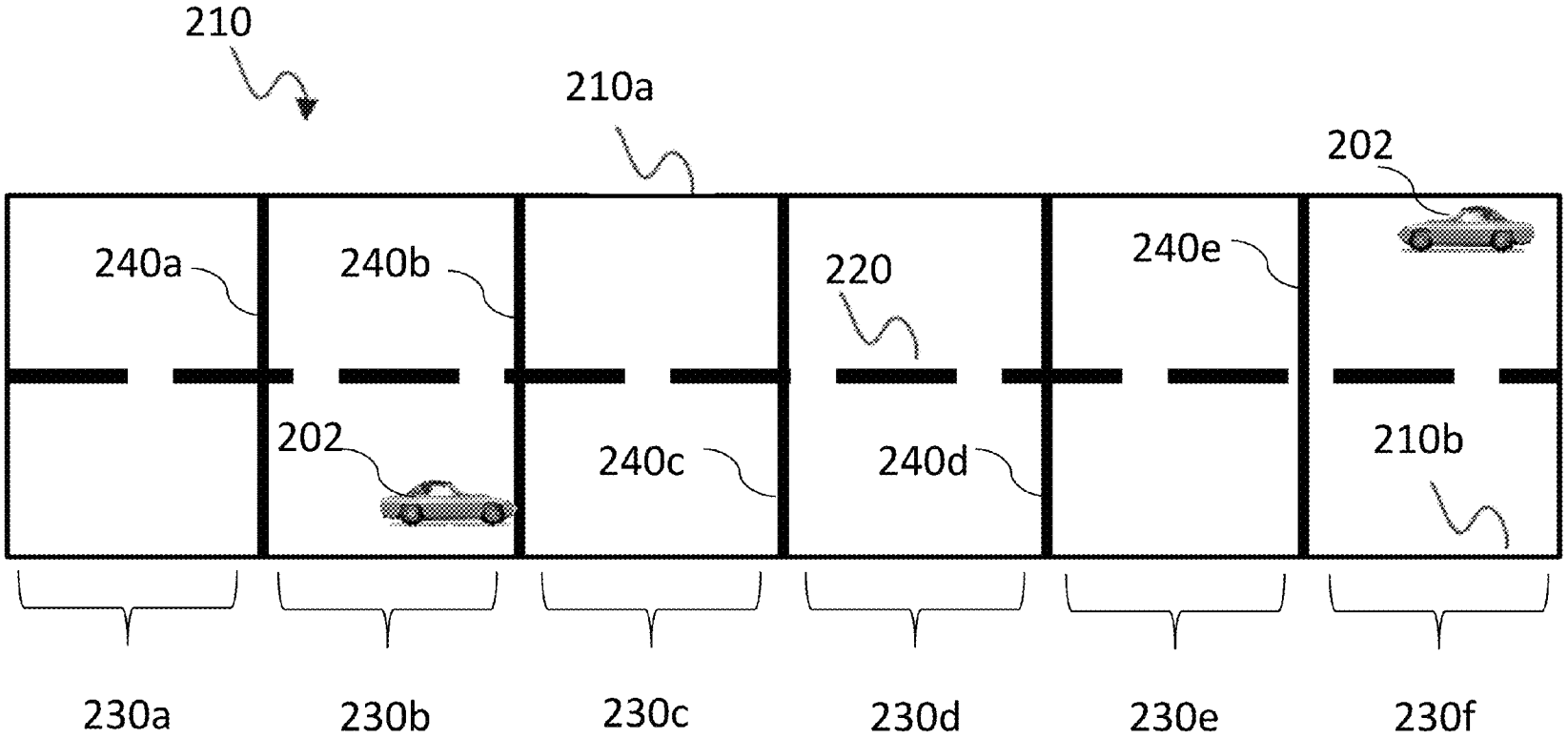
FIG. 4 illustrates an example of road splitting a candidate road into road segments via perpendicular bisectors.

FIG. 4 illustrates an example of how probe data may be collected from mobile devices in probe vehicles 202 or on travelers in the probe vehicles along a road 210. The probe data may be collected periodically. Periodically is defined as over time at intervals such that the intervals are not necessarily equally spaced and can be of any duration. Alternatively, in certain embodiments, the time intervals are evenly spaced.

In FIG. 4, the road 210 includes road or lane edges 210*a* and 210*b*. In certain embodiments, the edges represent road edges, wherein there are no additional lanes of traffic on the outside of each edge. In other embodiments, at least one of the edges represents a lane edge, wherein at least one additional lane of traffic exists outside of the edge, but is not depicted in FIG. 4. The road 210 may include at least one lane line 220 dividing two lanes of car traffic. In some embodiments, the lane line 220 represents a center line dividing two lanes of traffic traveling in opposite directions.

In certain embodiments, the road 210 is split or divided into a plurality of segments 230*a*, 230*b*, 230*c*, 230*d*, 230*e*, 230*f* by a number of perpendicular bisectors 240*a*, 240*b*, 240*c*, 240*d*, 240*e*. In some embodiments, the road segments are of equal length. In other embodiments, the road segments are not of equal length. The size (e.g., length) of each segment may contribute to the granularity of congestion/incident prediction and detection. The size of each segment may be varied based on the road's characteristics, such as, its location or typical traffic amount. For example, a highway or urban/downtown road may have a smaller road segment size, while a rural or sparingly traveled road may have a larger road segment size for probe data collection.

When the mobile device in a probe vehicle 202 submits probe data containing its geographic location, due to GPS inaccuracy, the geographic location may not necessarily place the probe vehicle 202 on the actual road 210, even though the probe vehicle 202 is actually travelling on the road 210. Thus, an adjustment or first map-matching process is needed to align the probe data with the road 210. Additionally, in certain embodiments, an additional, second map-matching process is implemented to adjust the aligned probe to its perpendicular bisector. In such embodiments, the first map-matching process matches the probe data to the road, while the second map-matching process matches the adjusted probe data to the perpendicular bisector of the road segments. Both processes may use different attributes of the probe data for matching.

Figure 5:
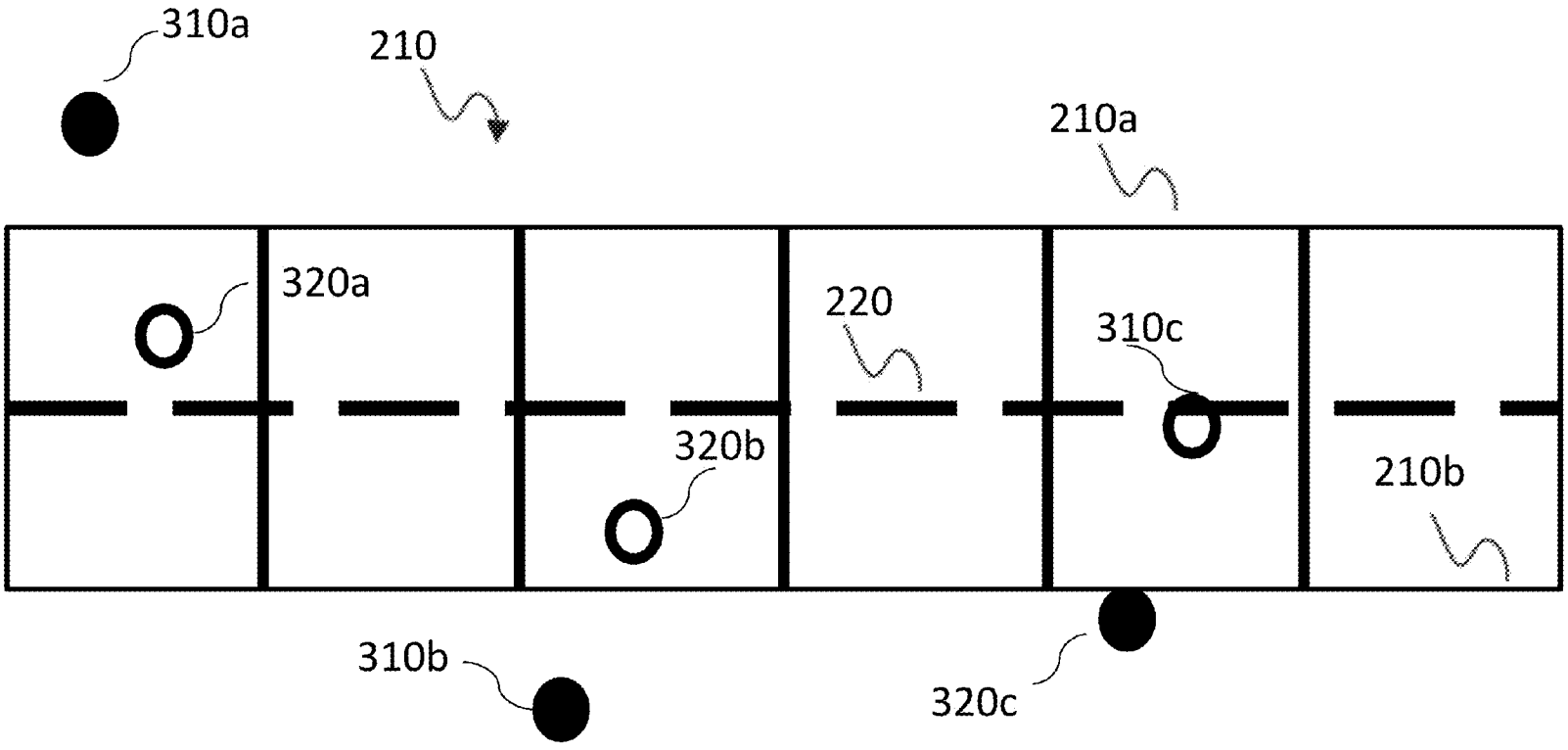
FIG. 5 illustrates an example of map-matching probe data to the road.

FIG. 5 illustrates an example of the first map-matching process. In this first map-matching process, incoming probe data is aligned to the road or a specific lane on the road. The first map-matching process may consider both the geographic location and heading of the mobile device in the probe vehicle or on the traveler. In other words, the first map-matching process may compare the distance between the probe data and the road, as well as the heading value of the probe and the heading value of the road.

In certain embodiments, the first map-matching process matches the geographic location probe data to the road or lane based on characteristic information of the road or lane (e.g., whether the road is a highway, residential street, three-lane road, or two-lane road). Additionally, the first map-matching process may take into account the accuracy of the positioning technique for the mobile device in the probe vehicle or on the traveler. For example, when GPS is used, accuracy depends on the line of sight to the sky. GPS may perform better in open rural areas than in urban areas or areas with other cover. The database used in the first map-matching process may include data indicative of GPS accuracy. The data indicative of GPS accuracy may describe whether or not specific geographic locations are considered an urban canyon, which is defined as an area dominated by tall buildings. Tall buildings may partially block GPS signals. The data indicative of GPS accuracy may indicate city or rural, may be a distance, or may be a value on a rating scale (e.g., 1 to 10). The data indicative of GPS accuracy may be derived from a building model stored in the database. The building model describes the two-dimensional footprint or the three-dimensional size of buildings. The server may access the building model and compare the relative sizes of buildings near the geographic location of the mobile device in the probe vehicle or on the traveler to a threshold level. Alternatively, the GPS accuracy for different locations is stored and accessed, received from the mobile device, or otherwise calculated.

The first map-matching process may also take into account baseline data determined from historical data. The historical data may be location points collected from vehicles following the same route. For example, probe vehicles may report a current geographic location positioned at a regular interval (e.g., every minute, every 20 seconds). Alternatively, the location points may be collected in response to requests sent from the server. The server may be configured to filter the data. For example, outliers may be removed. In addition, the server may average sets of collected location points to calculate the baseline. The sets of collected location points may be grouped in clusters dependent on the proximity of the location points with respect to one another.

In one non-limiting example, as shown in FIG. 5, three incoming probes 310*a*, 310*b*, 310*c* are reported by the same vehicle and map-matched to the road, creating three aligned probes 320*a*, 320*b*, 320*c*, respectively.

Figure 6:
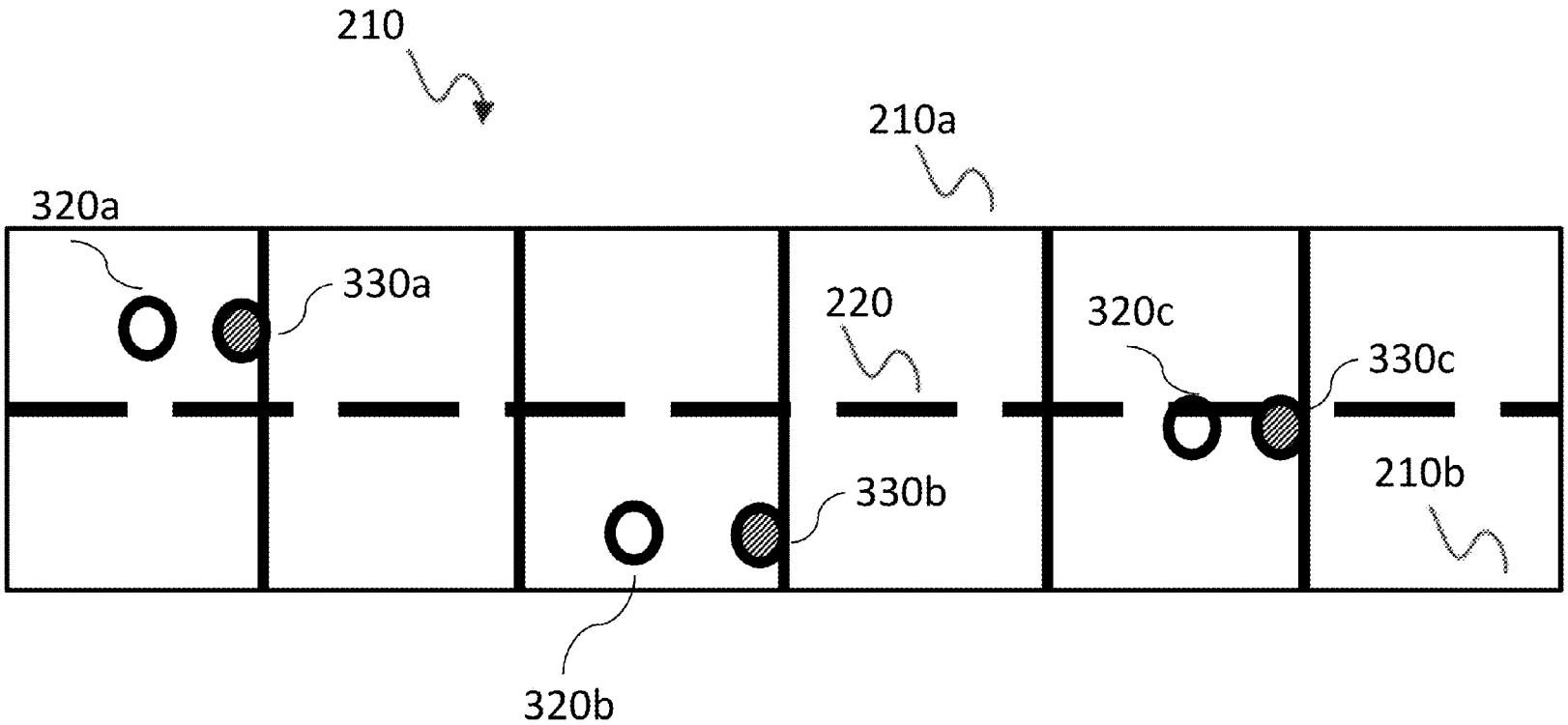
FIG. 6 illustrates an example of map-matching aligned probe data to the perpendicular bisector.

FIG. 6 illustrates an example of the second map-matching process, wherein the aligned probe data 320*a*, 320*b*, 320*c* from the first map-matching process is matched to the closest perpendicular bisector. This may allow for historic and real time probe data to be grouped and analyzed at the same road location. In some embodiments, the closest perpendicular bisector refers to the nearest bisector in front of and in the direction of travel of the aligned probe data. In other embodiments, the closest perpendicular bisector refers to the nearest measured bisector in either direction (i.e., the closest perpendicular bisector may be behind the probe vehicle's or traveler's direction of travel). As shown in FIG. 6, in this second map-matching process, the aligned probe data 320*a*, 320*b*, 320*c* is map-matched to the nearest perpendicular bisector in the direction of travel, creating double map-matched probes 330*a*, 330*b*, 330*c*, respectively.

Development of Temporal Congestion Profile

For each road or lane segment, after the second map-matching process, certain statistics or properties of the segment may be calculated for a determined time period, or a number of time periods. Over time, this historical data may be used in developing a machine learning algorithm or "threshold based" system for determining real time traffic incidents and congestion.

Figure 7:
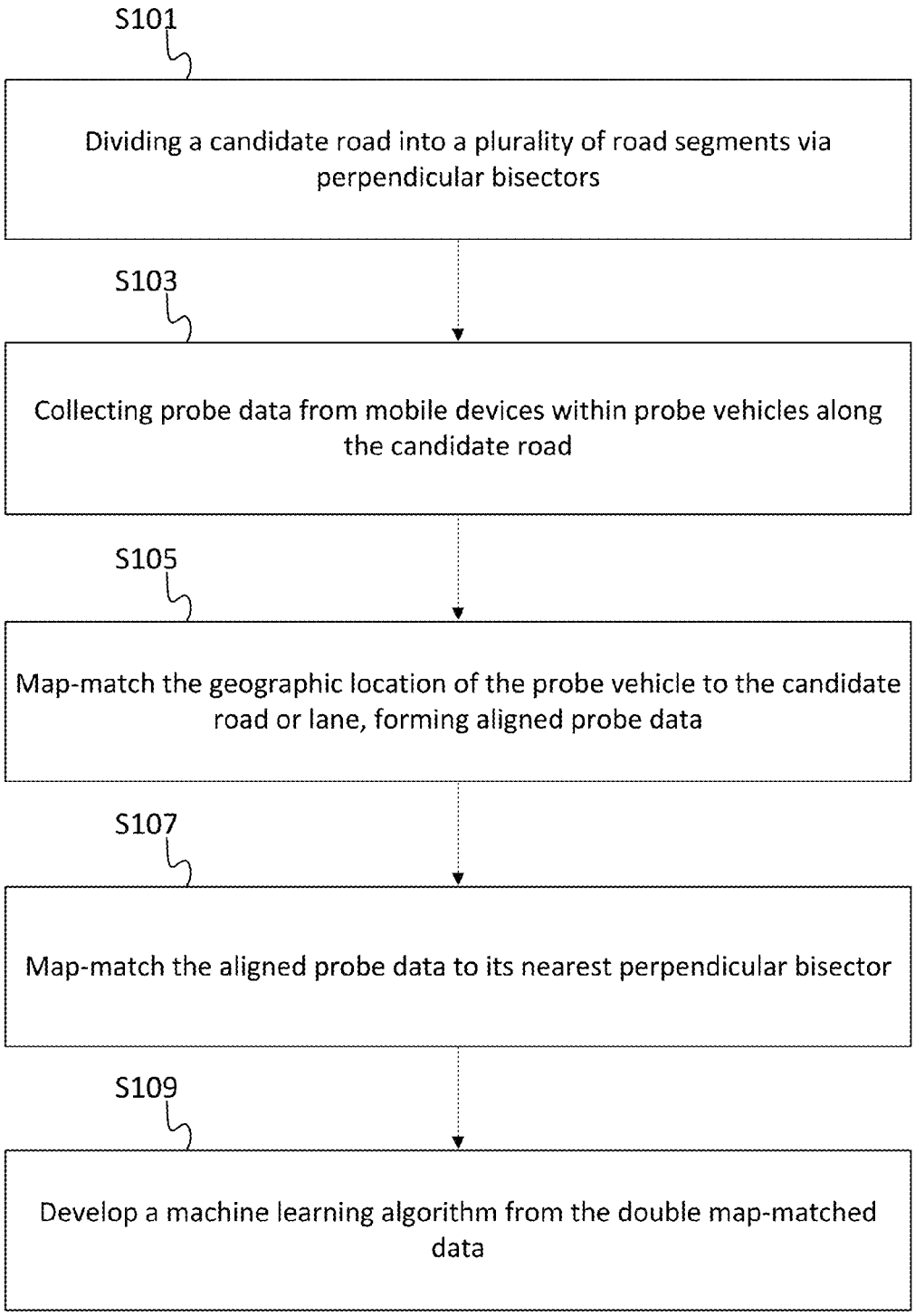
FIG. 7 illustrates an example flowchart for developing a learning machine algorithm from double map-matching probe data.

FIG. 7 illustrates an example flowchart for a machine learning algorithm from double map-matched probe data. The process of the flowchart may be performed by the mobile device 122 and controller 200 and/or server 125 and processor 300, which may be referred to alternatively as the controller in the following description. Alternatively, another device may be configured to perform one or more of the following acts. Additional, fewer, or different acts may be included.

At act S101, the controller divides a candidate road into a plurality of road segments via perpendicular bisectors. At act S103, the controller receives probe data from along the candidate road via a plurality of mobile devices 122 for a period of time (e.g., a 1 hour window between 9-10 am). The probe data includes the geographic location probe data of each mobile device/probe vehicle. The probe data may also include the speed and heading of each probe vehicle or traveler. At act S105, the controller conducts a first map-matching process, wherein the geographic location probe data is aligned to the candidate road, or a specific lane on the candidate road. At act S107, the controller conducts a second map-matching process, wherein the aligned probe data is matched to the nearest perpendicular bisector.

At act S109, the controller analyzes/calculates various properties the double map-matched data for each period of time. The calculated properties for each road or lane segment for each period of time may include (1) the frequency of probe vehicles or travelers (i.e., number of probe vehicles or travelers collected over the determined time period), (2) the average speed of the probe vehicles/travelers, and/or (3) the average heading of the probe vehicles/travelers. Over time, based on the number of probe data samples collected, map-matched, and analyzed, the machine learning algorithm can understand trends in each road segment.

In certain embodiments, the data collection is achieved for at a level of granularity such that each lane level/segment is observed. In other embodiments, the data collection is for a more course level of granularity such as the road level (and not each particular lane level). As noted, the probe data and resulting statistics may be computed with respect to time. The determined time period or time interval may be varied. In certain embodiments, the time interval may be at a daily, hourly, or minute level. For example, the time interval for the statistical calculations may be every 1 min, 5 min, 15 min, 30 min, 1 hr, or 24 hr. Further, the statistical calculations may be based on a comparison of probe data for a particular time period over a plurality of days (e.g., the average speed of a probe vehicle/traveler between a 9-10 am time period may be determined based on several days, months, or years of data collection). Also, in certain embodiments, the standard deviation may also be determined.

Figure 8:
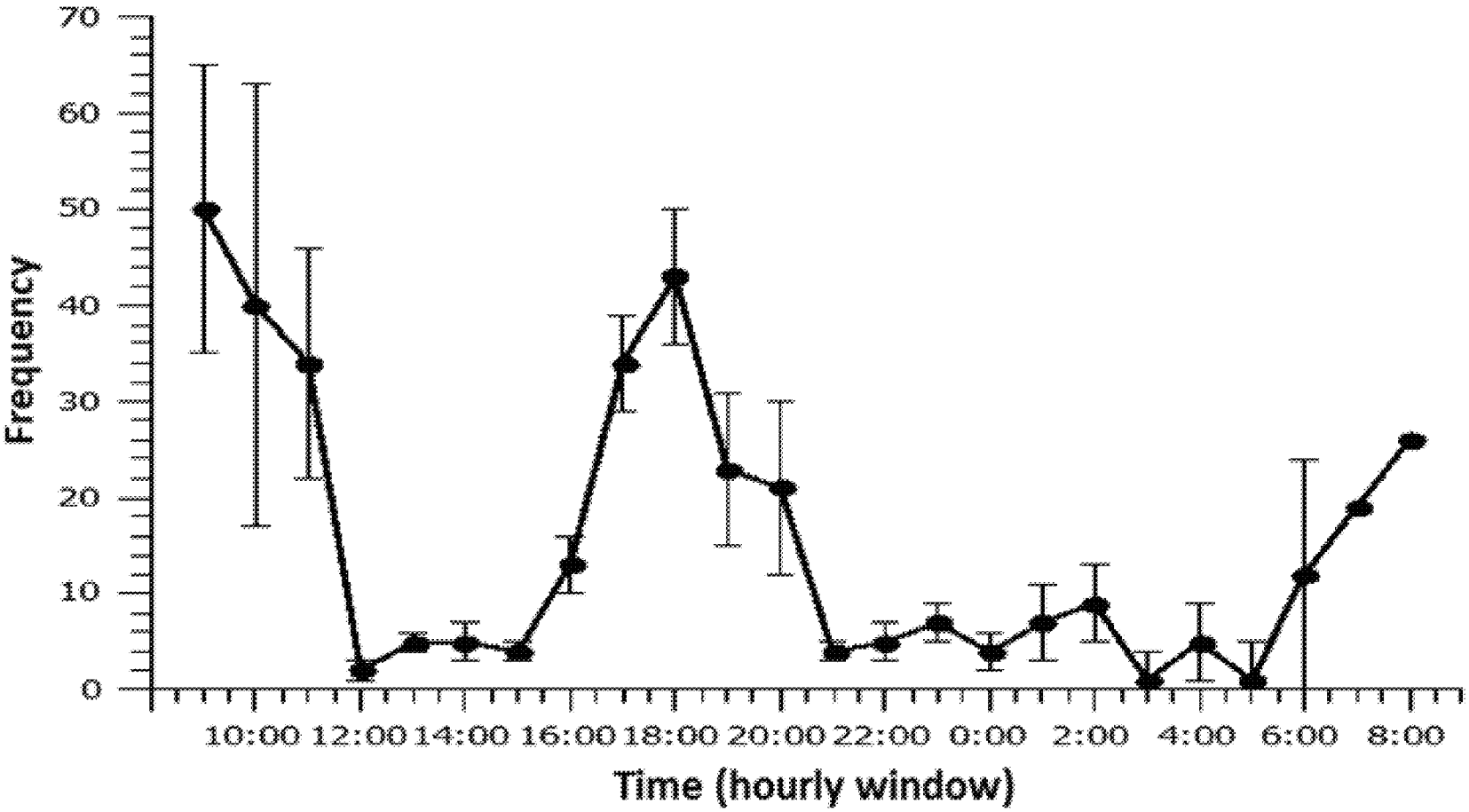
FIG. 8 illustrates an example of computed frequency measurements for a road segment as a function of time.
Figure 9:
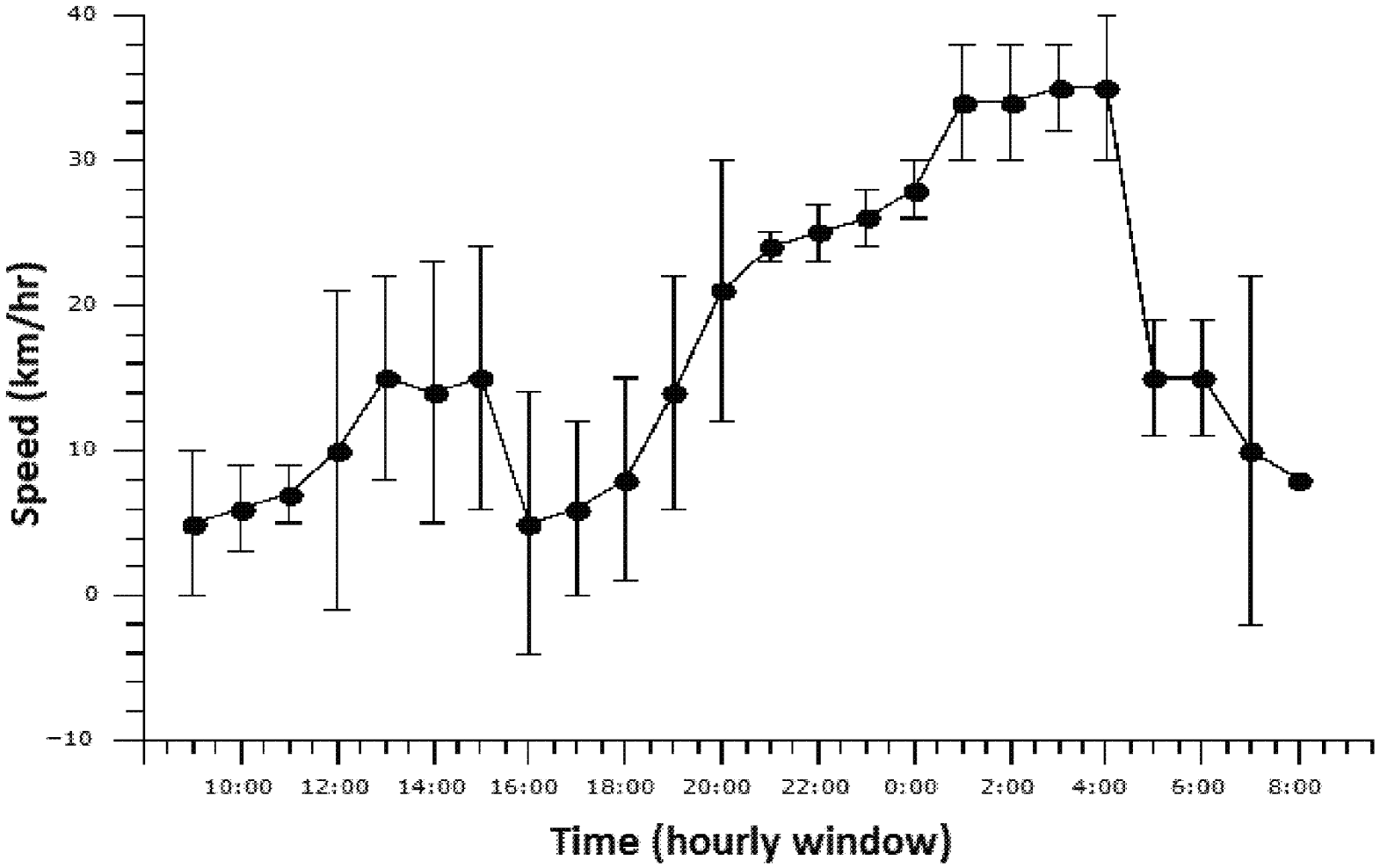
FIG. 9 illustrates an example of computed speed measurements for a road segment as a function of time.
Figure 10:
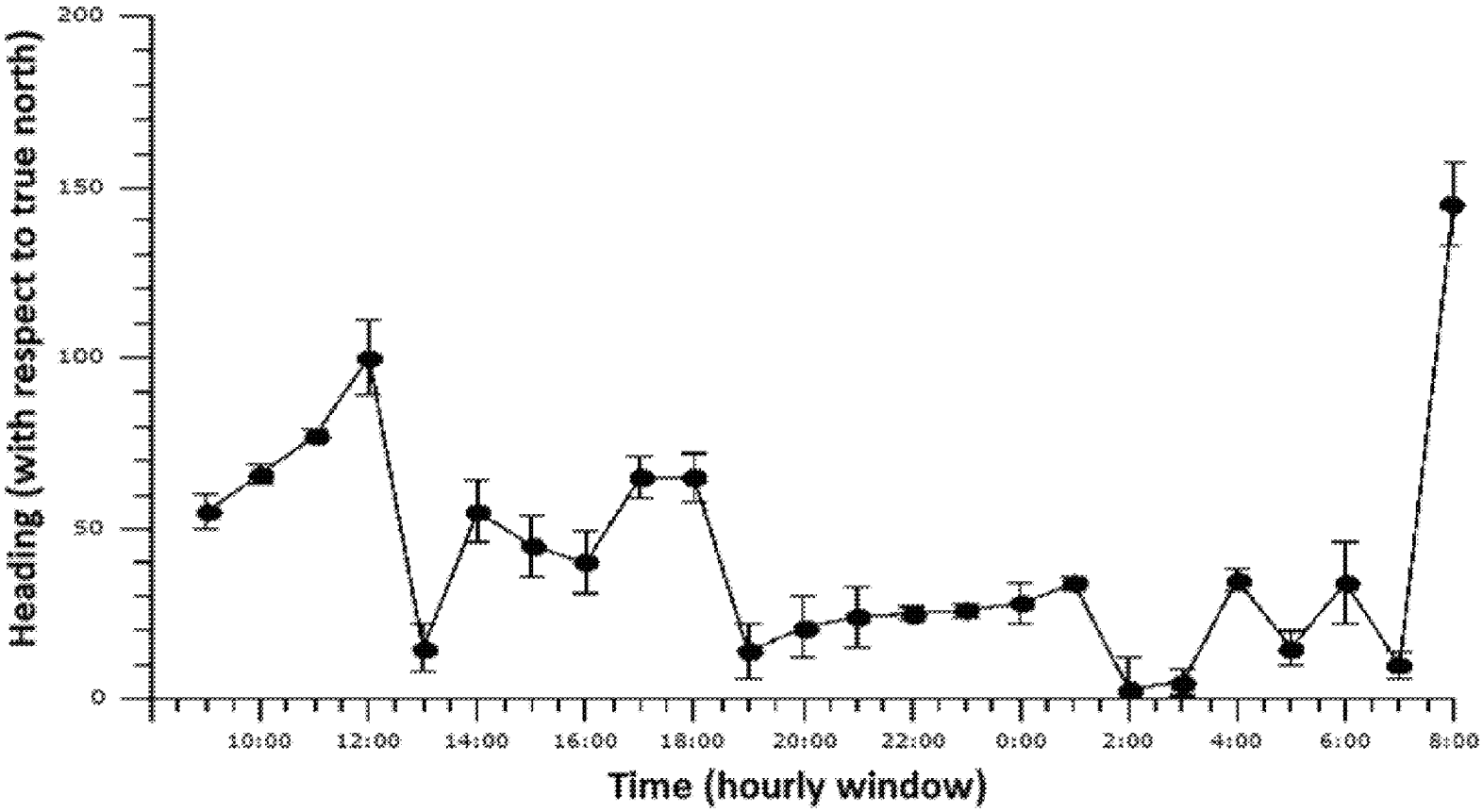
FIG. 10 illustrates an example of computed heading measurements for a road segment as a function of time.

FIGS. 8-10 illustrate embodiments of computed statistics for the frequency of probe vehicles or travelers, the average speed of the probe vehicles/travelers, and the average heading of the probe vehicles/travelers, respectively, in a selected road/lane segment at various periods of time. An hourly interval sample is employed in these embodiments. Further, the data is computed based on probes that are archived over several days, wherein each point in the curve represents the arithmetic mean for that hour and the error bars represent the standard deviation. For each segment, the mean and standard deviation of the frequency is computed and cached for each time period.

Figure 11:
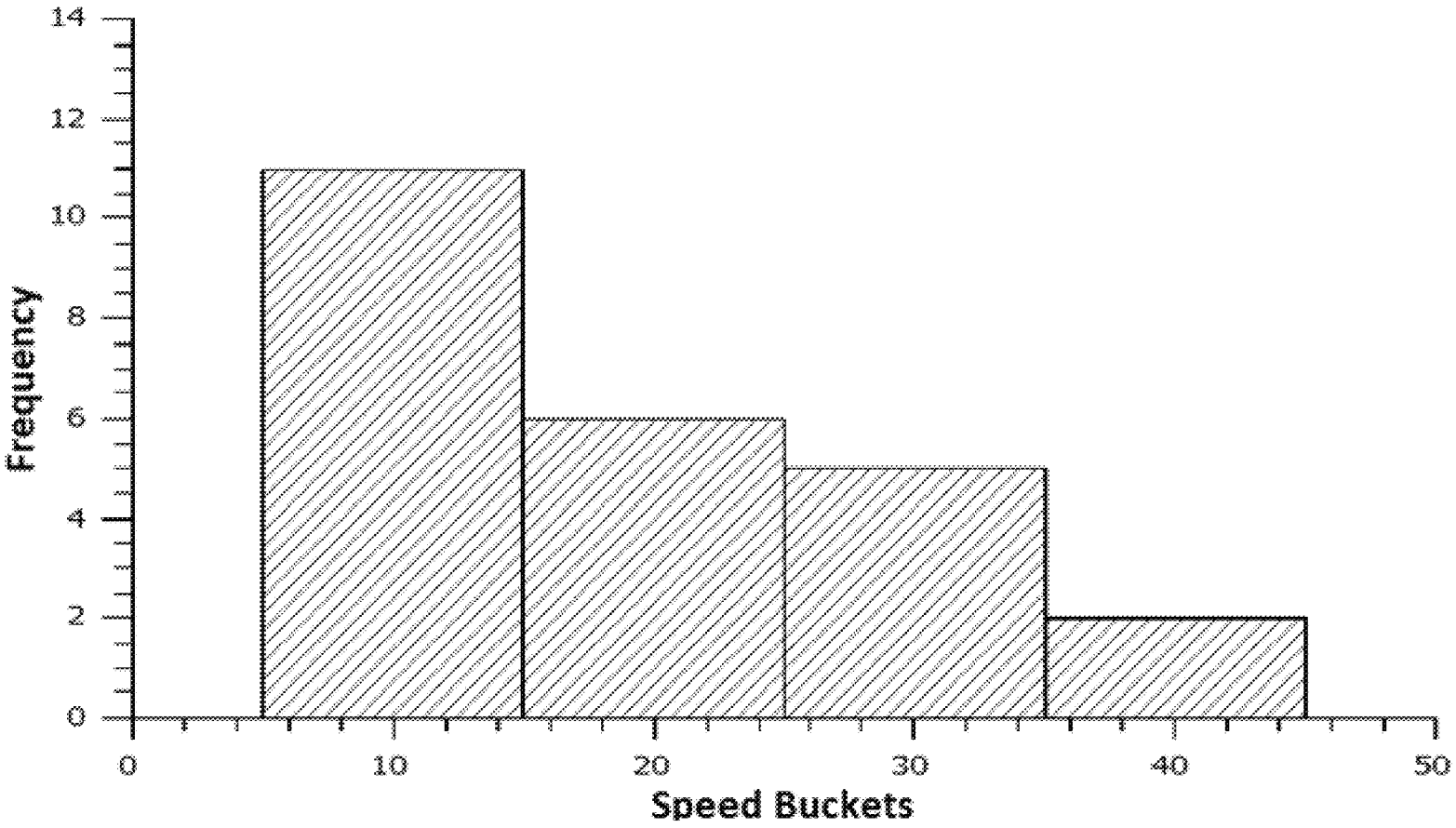
FIG. 11 illustrates an example of a speed distribution histogram for a single time period.
Figure 12:
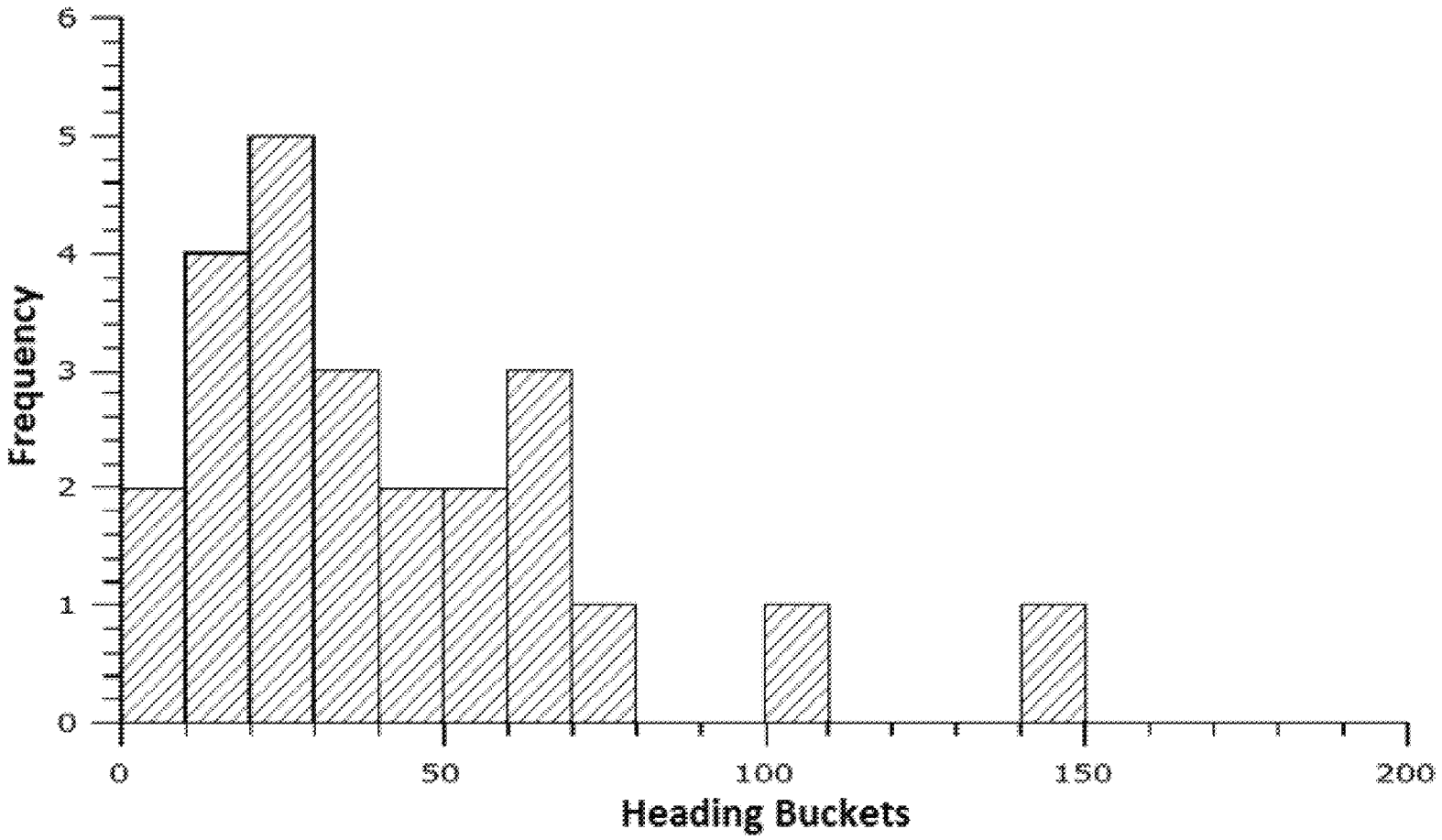
FIG. 12 illustrates an example of a heading distribution histogram for a single time period.

FIGS. 11 and 12 illustrate embodiments of histograms computed for particular lane/road segments at a particular time period (e.g., between 9-10 am). A separate histogram may be computed for each road/lane segment at each time period. The histogram in FIG. 11 shows the speed distribution during the time period, wherein each speed data point is placed into a particular speed "bucket" or bin, wherein the bucket refers to a tabulated collection of data points that all fall within a specified range. For example, speeds between 5-15 km/hr can be placed in a first bucket; speeds between 15-25 km/hr can be placed in a separate bucket; and so on. The histogram in FIG. 12 shows the heading distribution during the time period, wherein each heading data point is placed into a particular heading bucket. That is, headings between 0-10 degrees are placed in a single bucket; headings between 10-20 degrees are placed in a separate bucket; and so on. The size of each bucket may be varied. In certain embodiments, a normalization step is performed to normalize the data in the histogram. The normalization step for each bin of the histogram is computed as:

$$\frac{\text{Bin Frequency}}{\text{Total Number of Probes in Segment at Time Period}}$$

Based on a collection of a probe data described above, a temporal congestion profile may be formed from the calculated average frequency, speed, and/or heading for each road or lane segment at each determined time period. This temporal profile may be used to create classification feature vectors (e.g., a frequency feature vector, a speed feature vector, a heading feature vector). In certain embodiments, the classification feature vectors would include event labels that provide a high level description or semantic meaning of the event corresponding with the classification feature vector. Event labels could include high level descriptions such as "Regular Traffic," "Lane Blocked," "High Congestion," "Mild Congestion," or "Incident." For instance, the table below provides one embodiment of classification feature vectors based on the frequency, speed, and/or heading data.

| Time | Frequency feature | Speed feature (km/hr) | Heading change feature (degrees) | Event label |
|---|---|---|---|---|
| 9 to 10 | Mean: 45, Deviation: 6 | Mean: 17.2, Deviation: 4.1 Histogram: 0.3, 0, 0.4, 0.4 | Mean: 17.5, Deviation: 5.1 Histogram: 0.2, 0, 0.4, 0.4 | Regular traffic |
| 9 to 10 | Mean: 0, Deviation 6 | Mean: 0, Deviation: 0 Histogram: 0, 0, 0, 0 | Mean: 2.3, Deviation: 4 Histogram: 0, 0, 0, 0 | Lane blocked |
| 9 to 10 | Mean: 22.1, Deviation 2.4 | Mean: 1.2, Deviation: 2.3 Histogram: 1, 0, 0, 0 | Mean: 2.3, Deviation: 4 Histogram: 0, 1, 0, 0 | High Congestion |
| 9 to 10 | Mean: 6.1, Deviation 2.4 | Mean: 4.2, Deviation: 3.3 Histogram: 1, 0, 0, 0 | Mean: 12.3, Deviation: 4 Histogram: 0, 0.3, 0.7, 0 | Mild congestion |
| 9 to 10 | Mean: 45, Deviation: 6 | Mean: 4.2, Deviation: 3.3 Histogram: 1, 0, 0, 0 | Mean: 112.3, deviation: 4 Histogram: 0, 0.3, 0.7, 0 | incident |

In certain embodiments, the classification feature vectors may be used to train the machine learning algorithms. After training, the machine learning algorithm may automatically recognize these features. Thus, when new unlabeled road properties are fed as input, the machine algorithm may produce the corresponding event label output (e.g. "Lane Blocked"). Machine algorithms such as Random Forest, Decision Trees, Naïve Bayes, Neural networks, etc., may be used in this process. In certain embodiments, several machine learning algorithms may be tested and compared, wherein the algorithm with the highest accuracy on the training data is chosen.

In other embodiments, the classification feature vectors may be used in a "threshold based" system, wherein fixed threshold values for frequency, speed, and/or heading properties are implemented and compared with the temporal data. In certain embodiments, only one of the three classification feature vectors is used to make a road condition determination. In other embodiments, two of the three classification feature vectors are used. In yet other embodiments, all three of the classification feature vectors are used. For example, in one embodiment, if the average frequency is 0, the road condition label is "Lane Blocked." In another embodiment, if the average speed is 0, the road condition label is "Lane Blocked." In another embodiment, if the frequency is 0, the speed is 0 km/hr, the speed histogram contains all Os, the heading is 0 degrees, and the heading histogram contains all Os, then the road condition label is "Lane Blocked." In another embodiment, if the frequency is greater than 10, the speed is 0.2 km/hr, and the speed distribution histogram contains all Os except a first set of bins, the heading is less than 15 degrees, and the heading distribution contains all Os, then the road condition label is "Heavy Congestion."

Real Time Traffic Condition Determinations

Based on the machine learning algorithm or threshold based system developed from the historical data collection discussed above, real time traffic conditions may be determined.

In certain embodiments, real time traffic conditions are determined using a spatial sliding window that slides along the road and stops at each segment to access and analyze the data (i.e., sequential access of the data). In some embodiments, the spatial sliding window is positioned directly at candidate segment without passing sequentially through other segments (i.e., random access of the data).

In certain embodiments, the size of the spatial sliding window is dynamic (i.e., adjustable). In another embodiment, the size of the spatial window is fixed. As discussed above, in certain embodiments, the road being analyzed may be split or divided into a plurality of segments of equal or varying length by perpendicular bisectors. In certain embodiments, the spatial sliding window may slide and stop at each perpendicular bisector of the segments that arises from road splitting. When the spatial sliding window stops at a first perpendicular bisector, data from the probe vehicles/travelers and their mobile devices (e.g., frequency, speed, heading) within the sliding window may be collected and analyzed. In some embodiments, the size of the spatial sliding window may be stretched until a point before it reaches a second bisector or it may be stretched until it reaches the second bisector. Data within the spatial sliding window may be collected throughout the process. Through these methods, congestion/incident detection may be determined across the entire segment level or at a partial segment level.

Figure 13:
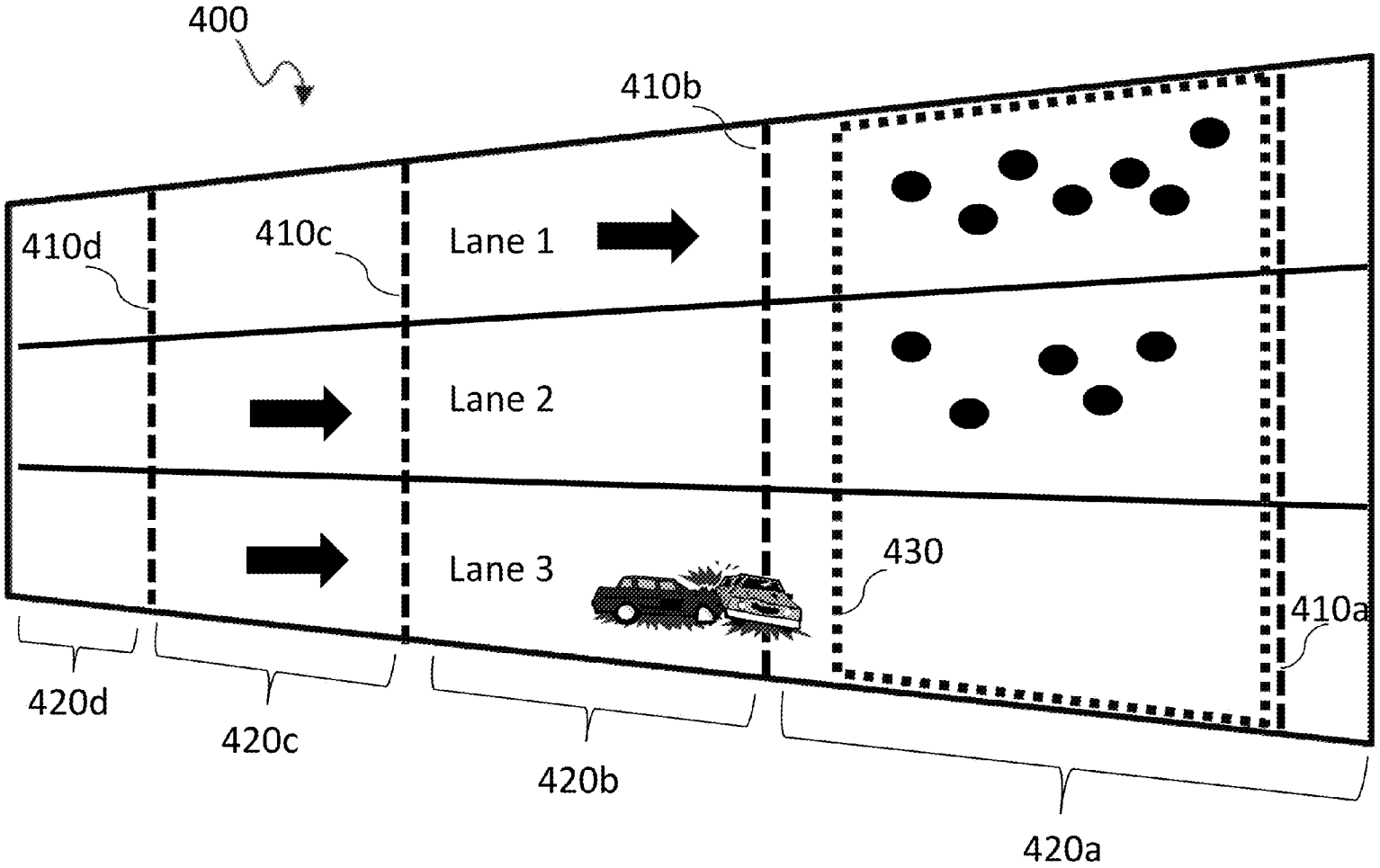
FIG. 13 illustrates an example of real time detection of incidents/congestion using a spatial sliding window.

FIG. 13 illustrates an embodiment of how a real time operation may be implemented. In FIG. 13, a three-lane, one-way road 400 includes four perpendicular bisectors 410*a*, 410*b*, 410*c*, 410*d* dividing the road into four segments 420*a*, 420*b*, 420*c*, 420*d*. A spatial sliding window 430 is aligned with the front edge of the first segment 420*a* and is contained within the first segment 420*a*. Real time probes on the road, within the spatial sliding window 430 are represented by black ovals. The arrows on the road 400 indicate the direction of travel.

In this embodiment, the data is being collected in real time, and the spatial sliding window 430 is expanded towards the perpendicular bisector 410*a* and the front edge of the second segment 420*b*. As previously noted, the sliding window 430 can extend to encompass the entire road segment or a fraction of the segment. As shown in FIG. 13, the spatial sliding window has been extended to encompass a fraction of the segment 420*a*.

Upon extending the sliding window, any mobile device found within the window (which has already undergone a first map-matching process to align the geographic location probe data with its lane location), may be map-matched to the front perpendicular bisector of the candidate segment (e.g., segment 420*a* in FIG. 13). The raw probe data and histogram properties for frequency, speed, and/or heading are extracted from the probes within the spatial sliding window. These properties are then fed into the machine learning system or the threshold based system to calculate a real time road/lane condition. Based on the collection of probe data (or lack thereof), the real time road/lane conditions at the road segment may be determined based on the comparison between the real time data (and its observed patterns) and the machine learning algorithm's historical data or the threshold based system. The conditions may be determined based on the following classification feature vectors: (1) the frequency (number) of probe vehicles or travelers observed in each lane, (2) the speed distribution of the probe vehicles/travelers in each lane, and/or (3) the heading distribution of the probe vehicles/travelers in each lane. As noted above, in certain embodiments, only one of the three classification feature vectors is used to make the road condition determination. In other embodiments, two of the three classification feature vectors are used. In yet other embodiments, all three of the classification feature vectors are used to make the real time determination.

For example, in FIG. 13, probe data collected within the spatial sliding window 430 provides frequency, speed, and heading data for lanes 1, 2, and 3. No real time probe data has been provided for lane 3. Based on the machine learning algorithm or the threshold based system, this may imply that lane 3 is closed at that road location, that an incident has occurred at some point within or before the spatial sliding window 430, or that no vehicle can utilize the lane.

In certain embodiments, based on data indicative of a lane incident or closure, the spatial sliding window 430 may be shifted along the road to a separate road segment (e.g., 420*b*, 420*c*, 420*d*) or stretched further within the road segment 420*a* to determine the exact point where the lane became inactive. The spatial sliding window may be shifted along the road while observing the frequency, speed, and heading data. In certain embodiments, distribution histogram curves are observed. For example, in some embodiments, the location of an incident or lane closure is the point on the road where the frequency/distribution of probe vehicles or travelers shifts drastically from a higher density to a low density (e.g., zero probe vehicles/travelers). Additionally, the time of lane inactivity may be observed from the real time probe points within the sliding window.

Intuitively, for example, if a lane is fully blocked, then the frequency is 0, the heading and speed histograms are empty and the heading and speed mean is 0. Additionally, if a lane has an incident, then at some point in that lane there is massive heading change where vehicles are switching to other lanes and also lower speed is observed. Thus, the mean heading is high and the latter bins in the heading distribution histogram have higher weight. This can be captured by the machine learning system or the threshold based system.

In certain embodiments, the location of an incident or lane closure is the point on the road where there is noticeable heading change that falls outside the standard deviation of the historical data for that segment of the road. This may indicate that the probe vehicles or travelers within that particular lane are changing lanes. In yet other embodiments, the location of an incident or lane closure is the point on the road where there is a noticeable speed change that indicates the probe vehicles or travelers have slowed down or stopped within the lane (prior to changing lanes) based on the incident in front of the vehicle. In certain embodiments, a combination of factors may be used to indicate an incident or lane closure, such as a combination of (1) frequency and heading probe data, (2) frequency and speed data, or (3) frequency, speed, and heading data. Determinations of mild congestion, high congestion, and regular traffic may also be determined with the spatial sliding window to pinpoint whether there is any congestion at all, or the location at which the mild or high congestion begins and dissipates.

As observed within FIG. 13, when the spatial sliding window is shifted to road segment 420*b*, the machine learning algorithm or threshold based system will detect the location of the incident or road closure.

Figure 14:
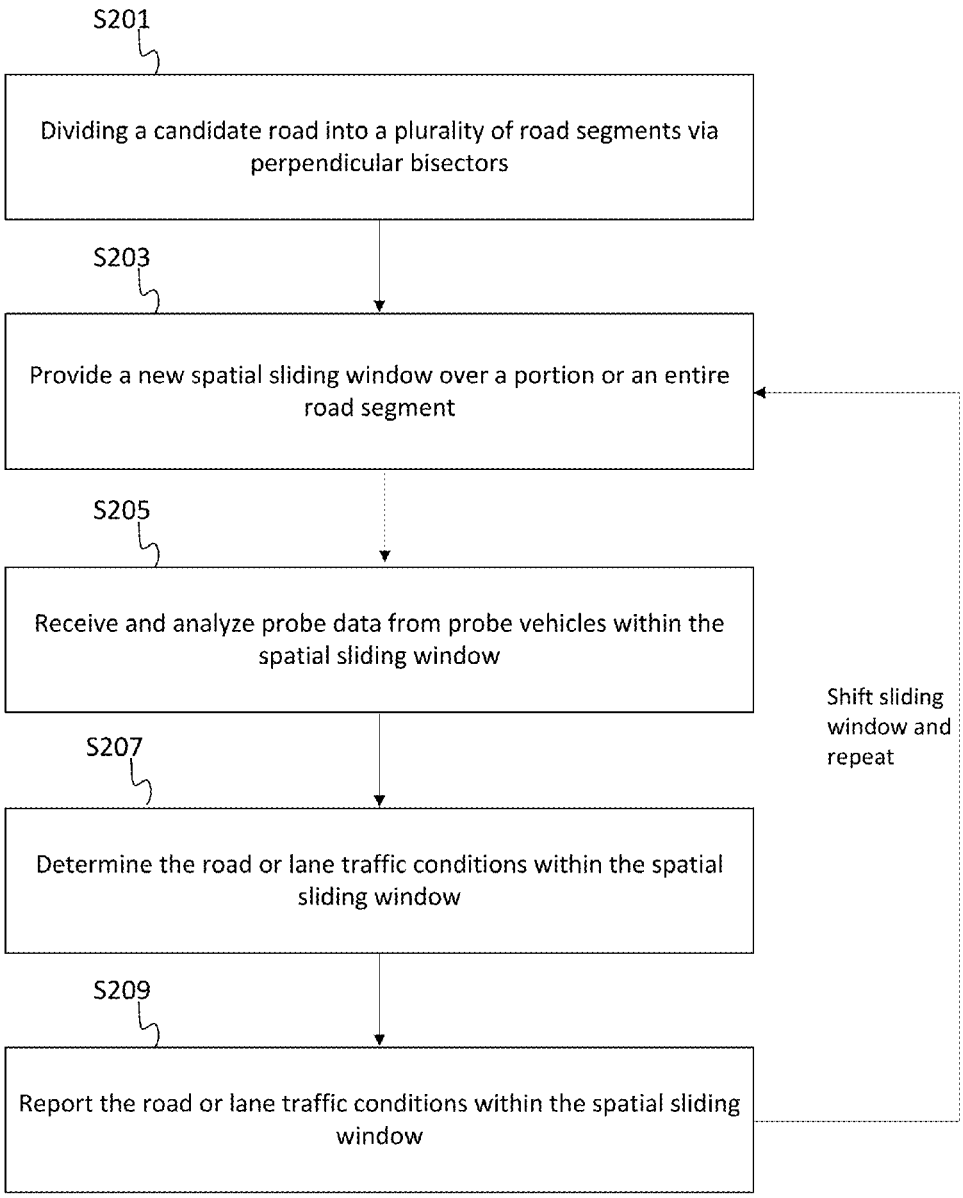
FIG. 14 illustrates an example flowchart for determining real time traffic incidents/congestion.

FIG. 14 illustrates an example flowchart for determining a traffic incident or road block from the map-matched probe data. The process of the flowchart may be performed by the mobile device 122 and controller 200 and/or server 125 and processor 300, which may be referred to alternatively as the controller in the following description. Alternatively, another device may be configured to perform one or more of the following acts. Additional, fewer, or different acts may be included.

At act S201, the controller divides a candidate road into a plurality of road segments via perpendicular bisectors. At act S203, a spatial sliding window is aligned with the front edge of a road segment and is contained within the road segment. In some embodiments, the window encompasses a fraction of the road segment. In other embodiments, the window encompasses the entire road segment.

At act S205, the controller receives and analyzes the real time probe data from the probe vehicles or on travelers within the spatial sliding window. This may include analyzing the frequency of probe vehicles/travelers, the speed of the probe vehicles/travelers, and/or the heading of the probe vehicles/travelers within the window. In certain embodiments, the controller has already aligned the probe data has been map-matched to align the probe vehicle or traveler with the road or lane segment. The aligned probe data within the sliding spatial window may also be map-matched to the perpendicular bisector at the front edge of the sliding window.

At act S207, based on the analysis of the probe data, the controller determines the traffic conditions for the road or lane within the spatial sliding window. The controller can make a determination by comparing the real time probe data with the machine learning algorithm's historical data or a threshold based system as to whether a traffic incident or road block exists within the, or within a specific lane of the road.

At act S209, the controller reports the traffic conditions of the road or lane within the spatial sliding window. This may include reporting that a traffic incident or road closure exists within a particular lane, or that there is mild or heavy congestion within the lane. In certain embodiments, the process returns to act S203, wherein the controller continues to analyze and shift the spatial sliding window after reporting an incident or road block, in order to continue reporting real time traffic information (including lane clearings after incidents have been alleviated or road blocks cleared). In certain embodiments, cycling back to act S203 allows the controller the ability to shift the spatial sliding window to determine the exact location along a road or lane where a traffic condition (e.g., a road closure or incident) has commenced.

Definitions and Support for the Above-Described Embodiments

In the above described embodiments, the network 127 may include wired networks, wireless networks, or combinations thereof. The wireless network may be a cellular telephone network, an 802.11, 802.16, 802.20, or WiMax network. Further, the network 127 may be a public network, such as the Internet, a private network, such as an intranet, or combinations thereof, and may utilize a variety of networking protocols now available or later developed including, but not limited to TCP/IP based networking protocols.

While the non-transitory computer-readable medium is described to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

As used in this application, the term "circuitry" or "circuit" refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Processors suitable for the execution of a computer program include, by way of example, both general and special purpose microprocessors, and anyone or more processors of any kind of digital computer. Generally, a processor receives instructions and data from a read only memory or a random access memory or both. The essential elements of a computer are a processor for performing instructions and one or more memory devices for storing instructions and data. Generally, a computer also includes, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., E PROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

What is claimed is:

1. A method comprising:

dividing a candidate road into road segments by perpendicular bisectors;

receiving probe data from mobile devices in probe vehicles or on travelers on the candidate road, wherein the probe data includes geographic location probe data;

performing, using a processor, a first map-matching process, wherein the geographic location probe data is aligned to the candidate road or a specific lane on the candidate road, forming aligned probe data; and performing, using the processor, a second map-matching process, wherein the aligned probe data is shifted to and grouped at a closest perpendicular bisector in a direction of travel for each mobile device, forming double map-matched probe data configured to be analyzed and compared with real time probe data aligned and shifted to a same geographic location.

2. The method of claim 1, further comprising:

analyzing the double map-matched probe data for at least one time interval; and determining at least one of the following characteristics: an average frequency, an average speed, an average heading, a speed distribution histogram, and a heading distribution histogram for the probe data within at least one of the road segments for the at least one time interval.

3. The method of claim 2, further comprising:

creating a historical database of the analyzed double map-matched probe data for each of the road segments for multiple time intervals; and developing a machine learning algorithm or a threshold based system to determine traffic conditions.

4. The method of claim 3, wherein the traffic conditions are determined by the machine learning algorithm and based on a comparison between the historical database and a selected probe data sample.

5. The method of claim 4, wherein the comparison between the historical database and the selected probe data sample involves at least one of the following comparisons: the average frequency, the average speed, the average heading, the speed distribution histogram, and the heading distribution histogram.

6. The method of claim 3, wherein the traffic conditions are determined by the threshold based system and based on a comparison between and a selected probe data sample and fixed threshold values for frequency, speed, and/or heading.

7. A method comprising:

dividing a candidate road into road segments by perpendicular bisectors;

positioning a spatial sliding window over at least a portion of a road segment, wherein the spatial sliding window aligns with a front end of the road segment in a direction of travel of the road segment;

receiving real time probe data from mobile devices in probe vehicles or on travelers of the at least a portion of the road segment within the spatial sliding window, wherein the real time probe data has undergone first and second map-matching processes, wherein geographic location probe data from the real time probe data is aligned to the candidate road or a specific lane on the candidate road, forming aligned probe data, and wherein the aligned probe data is shifted to and grouped at a closest perpendicular bisector in a direction of travel for each mobile device, forming double map-matched probe data;

analyzing, by a processor, the real time probe data;

determining real time traffic conditions of the at least a portion of the road segment within the spatial sliding window, wherein the real time traffic conditions are determined based on a machine learning algorithm or a threshold based system, wherein the real time probe data is compared with a historical database of probe data aligned and shifted to the same road or lane segment for a same time period; and reporting the real time traffic conditions.

8. The method of claim 7, further comprising:

stretching the spatial sliding window to encompass a larger portion of the road segment or moving the spatial sliding window to a new road segment;

receiving additional real time probe data; and analyzing the additional real time probe data.

9. The method of claim 8, further comprising:

determining a beginning location of a traffic incident or road blockage by sequentially moving the spatial sliding window between road segments.

10. An apparatus comprising:

at least one processor; and at least one memory including computer program code for one or more programs; the at least one memory and the computer program code configured to, with the at least one processor, cause the apparatus to at least perform:

divide a candidate road into road segments by perpendicular bisectors;

receive probe data from mobile devices in probe vehicles or on travelers on the candidate road, wherein the probe data includes the geographic location probe data;

perform a first map-matching algorithm, wherein the geographic location probe data is aligned to the candidate road or a specific lane on the candidate road, forming aligned probe data; and perform a second map-matching algorithm, wherein the aligned probe data is shifted to and grouped at a closest perpendicular bisector in a direction of travel for each mobile device, forming double map-matched probe data configured to be analyzed and compared with real time probe data aligned and shifted to a same geographic location.

11. The apparatus of claim 10, wherein the at least one memory and the computer program code are configured to cause the apparatus to further perform:

analyze the double map-matched probe data for at least one time interval; and determine at least one of the following characteristics: an average frequency, an average speed, an average heading, a speed distribution histogram, and a heading distribution histogram for the probe data within at least one of the road segments for the at least one time interval.

12. The apparatus of claim 11, wherein the at least one memory and the computer program code are configured to cause the apparatus to further perform:

create a historical database of the analyzed double map-matched probe data for each of the road segments for multiple time intervals; and develop a machine learning algorithm or a threshold based system to determine traffic conditions.

13. The apparatus of claim 12, wherein the traffic conditions are determined based on a comparison between the historical database and a selected probe data sample.

14. An apparatus comprising:

at least one processor; and at least one memory including computer program code for one or more programs; the at least one memory and the computer program code configured to, with the at least one processor, cause the apparatus to at least perform:

divide a candidate road into road segments by perpendicular bisectors;

position a spatial sliding window over at least a portion of a road segment, wherein the spatial sliding window corresponds to a front end of the road segment in a direction of travel of the road segment;

receive real time probe data from mobile devices in probe vehicles or on travelers of the at least portion of the road segment within the spatial sliding window, wherein the real time probe data has undergone first and second map-matching processes, wherein geographic location probe data from the real time probe data is aligned to the candidate road or a specific lane on the candidate road, forming aligned probe data, and wherein the aligned probe data is shifted to and grouped at a closest perpendicular bisector in a direction of travel for each mobile device, forming double map-matched probe data;

analyze the real time probe data;

determine real time traffic conditions of the at least a portion of the road segment within the spatial sliding window, wherein the real time traffic conditions are determined based on a machine learning algorithm or a threshold based system, wherein the real time probe data is compared with a historical database of probe data aligned and shifted to the same road or lane segment for a same time period; and report the real time traffic conditions.

15. The apparatus of claim 14, wherein the at least one memory and the computer program code are configured to cause the apparatus to further perform:

stretch the spatial sliding window to encompass a larger portion of the road segment or moving the spatial sliding window to a new road segment;

receive additional real time probe data; and analyze the additional real time probe data.

16. The apparatus of claim 15, wherein the at least one memory and the computer program code are configured to cause the apparatus to further perform:

determine a beginning location of a traffic incident or a road blockage by sequentially moving the spatial sliding window between road segments.

* * * * *